United States Patent [19]

Memminger et al.

[11] 4,271,686

[45] Jun. 9, 1981

[54] THREAD OR YARN SUPPLY APPARATUS WITH MOVABLE THREAD SUPPLY GUIDE MEANS, PARTICULARLY FOR CIRCULAR KNITTING MACHINES

[75] Inventors: Gustav Memminger, Freudenstadt; Falk Kühn, Kiebingen, both of Fed. Rep. of Germany

[73] Assignee: Memminger GmbH, Freudenstadt, Fed. Rep. of Germany

[21] Appl. No.: 929,995

[22] Filed: Aug. 1, 1978

[51] Int. Cl.[3] ..... D04B 15/44; D04B 15/48

[52] U.S. Cl. ..... 66/146; 66/125 R; 66/163; 242/47.01

[58] Field of Search ..... 66/125 R, 132 T, 132 R, 66/146; 242/47.01

[56] References Cited

U.S. PATENT DOCUMENTS

| | | | |
|---|---|---|---|
| 2,745,609 | 5/1956 | Lermont | 66/163 X |
| 3,094,855 | 6/1963 | Vossen | 66/163 |
| 3,820,731 | 6/1974 | Rosen | 242/47.01 X |
| 3,883,083 | 5/1975 | Rosen | 66/132 R X |
| 4,015,447 | 4/1977 | Philip | 66/132 R |
| 4,027,505 | 6/1977 | Mishcon et al. | 66/132 T X |
| 4,047,398 | 9/1977 | Fecker et al. | 66/132 R |
| 4,056,237 | 11/1977 | Fecker et al. | 66/132 R X |
| 4,075,445 | 2/1978 | Kempf | 66/163 X |
| 4,114,823 | 9/1978 | Fecker et al. | 66/132 R X |

FOREIGN PATENT DOCUMENTS

| | | | |
|---|---|---|---|
| 1288229 | 1/1969 | Fed. Rep. of Germany | 242/47.01 |
| 2639206 | 3/1978 | Fed. Rep. of Germany | 66/132 T |
| 2283971 | 4/1976 | France | 66/132 T |
| 2361297 | 3/1978 | France | 242/47.01 |

*Primary Examiner*—Wm. Carter Reynolds

*Attorney, Agent, or Firm*—Frishauf, Holtz, Goodman & Woodward

[57] ABSTRACT

The supply portion to a thread supply drum is pivotally located on the holder for the drum, to pivot about an axis transverse to the axis of rotation of the drum; this supply portion carries a thread brake 24, an inlet eye 27, and a further inlet guide element 26. Preferably, the supply portion is removably located on the holder 1, for example by means of a plug-and-socket connection, a slide-in dovetail joint, or the like. Pivotal connection permits compensation for short-time tension peaks arising, for example, upon yarn drag, and combination with a stop-motion switch.

25 Claims, 6 Drawing Figures

THREAD OR YARN SUPPLY APPARATUS WITH MOVABLE THREAD SUPPLY GUIDE MEANS, PARTICULARLY FOR CIRCULAR KNITTING MACHINES

REFERENCE TO RELATED APPLICATIONS

U.S. Pat. Ser. No. 929,996, filed Aug. 1, 1978, MEMMINGER KÜHN, for "Rapid Maintenance Thread or Yarn Supply Apparatus, Particularly for Circular Knitting Machines";

U.S. Pat. Ser. No. 827,966, filed Aug. 26, 1977, FECKER et al, now U.S. Pat. No. 4,114,823, Fecker and Memminger, both assigned to the assignee of the present application, as well as the following U.S. patents, also assigned to the assignee of the present application:

U.S. Pat. No. 4,028,911; Fecker et al

U.S. Pat. No. 4,047,398; Fecker et al

U.S. Pat. No. 4,056,239; Fecker and Memminger.

The present invention relates to a thread supply apparatus, and more particularly to thread supply apparatus for a circular knitting machine which is arranged for attachment to a carrier ring on the knitting machine, and which has a rotating supply drum on which a thread storage winding can be wound.

Various types of thread supply devices for textile machinery, and specifically for circular knitting machines, have been proposed. Many such devices have rotating drums on which a thread is fed in tangential direction, to form a thread supply storage winding thereon. The thread is then pulled off from the drum either with the same speed as the wind-on speed, tangentially, from the drum or, at a demand speed, head-over-end from the drum. Such thread supply drums have supply thread guide eyes, and run-off or take-off guide eyes associated therewith to properly guide the thread thereto. To control tension of thread being supplied, a thread brake is usually placed ahead of the supply drum.

It is customary to rigidly secure the thread brake and the thread supply eye ahead of the thread supply drum. Some arrangements have been proposed in which the supply brake is located adjacent the actual thread supply device, directly secured to the carrier ring of the knitting machine, or on the carrier support rack for the yarn packages which supplies the yarn to the machine.

It may occur that the supply of thread from the yarn package to the storage drum is temporarily impaired. This may occur if, for example, overlapping windings on the yarn package twist together or catch with respect to each other, thus forming short-time tension peaks with respect to the thread supply drum. Such tension peaks, formed by yarn drag, may lead to breakage of the yarn or thread being supplied to the storage windings if they exceed the breaking strength of the yarn or thread itself. To prevent yarn breakage, it has been proposed to increase the length of the thread path between the yarn or thread being supplied from the yarn package and the storage supply drum in order to obtain some compensation for yarn drag due to the length of the yarn—which, of course, is somewhat elastic—between the supply package and the yarn or thread supply device for the knitting machine itself. Yarn drag stop-motion devices have also been proposed, at times associated with the holder for the yarn packages themselves, and possibly combined with other stop-motion devices, for example with optical scanners which operate the knitting machine stop-motion safety system upon sensing breakage of the yarn, or excessive drag.

A tall spool carrier arrangement or remote positioning of spool carriers is necessary in order to increase the length of the path of the yarn from the supply package to the thread supply device; drag stop-motion sensors or optical sensors associated with the yarn packages themselves also require space and, like specially constructed tall yarn package supply carriers, are costly.

When threading yarn supplied from packages, it is necessary to thread it through the thread brake at the supply side to the yarn delivery devices. The space adjacent the yarn supply drums and devices is usually restricted and threading of yarn through the inlet eyes and through the thread brake is difficult since the eyes and the thread brake, as well as other guide elements, need be very close together.

THE INVENTION

It is an object to provide a thread supply device which automatically compensates for yarn drag and which, additionally, is so constructed that the threading of the yarn supply device, and hence of the machine, is substantially facilitated.

Briefly, the thread brake is located on the holder which, preferably, also holds the yarn supply drum. It is movable for limited deflection with respect to the yarn supply drum by being attached to a supply portion which, in turn, is movably, preferably pivotably for limited deflection, connected to the holder for the thread supply drum. Preferably, the movably or pivotably secured supply portion carries both the supply guide eye as well as the supply thread brake, although it may carry only either, the thread brake or the supply eye.

The arrangement is so made that the supply brake can deflect backwardly in the path of thread supply if the tension of the thread should increase, so that, if a drag on the supply thread should occur, the increased thread tension will permit resilient yielding of the thread brake, thereby providing for automatic compensation of the drag, and preventing breakage of the yarn or thread. Additionally, by locating the thread brake in a manner so that it can be moved away from the supply position to the supply drum, threading of the thread or yarn to the drum is greatly facilitated since the circumference of the drum will be much more readily accessible than when the thread brake is located adjacent thereto in the thread path.

The supply portion, connected to the holder for the storage drum, can carry various elements; for example, and in accordance with a preferred embodiment, a hook-shaped guide element is secured to the movable portion. Such an element ensures that the upper winding of the constantly renewed storage windings on the drum always will have the proper and correct position; it may, additionally, form a counter bearing or stop for an arm which carries both a thread supply guide eye and an arm which carries the yarn drag sensing stop-motion element.

The physical arrangement of the parts is particularly simple if, in accordance with a feature of the invention, the supply portion is pivotably secured to the holder arm to pivot about an axis which is transverse with respect to the axis of rotation of the storage drum. The supply part, preferably, can be locked in a predetermined position with respect to the holder if special types of yarns or special types of knitting stitches are to be carried out, and when the compensating feature is not desired—a situation which may arise when knitting, for example, plush fabric, or using slubbed yarns. More than one predetermined locked position may be desirable—depending on the construction of the machine, and of the drive system for the supply drums. Thus, it may be desirable to provide a locked position for the supply thread brake and guide eye which facilitates placing of a drive belt around the drive portion of a drum structure to have more access and working space during maintenance or repair of the knitting machine, and the drive system thereof.

High-capacity circular knitting machines which have a large number of knitting feeds—for example 36, 48, or more—are so compact that little space is available for the yarn supply devices. It has been found desirable, therefore, to locate yarn supply apparatus or devices in various staggered planes. This increases the cost of the machine, and the cost of maintenance work. To permit locating as many yarn supply devices as possible on the circumference of the machine in a single plane, it has been found desirable to make the width of the holder element for any one of the yarn supply devices less than, or at most equal to the diameter of the storage drum. Preferably, the axis of rotation is located on the longitudinal center line of the holder element. Such a construction permits, then, to form the supply portion in the shape of an essentially flat rail, on a side of which the supply thread brake is located. The rail may also be shaped in various ways, for example with a lateral notch or relief, to receive the thread brake therein, a guide element then being located adjacent a shoulder which defines the notch or recess in the rail, thereby further decreasing the spatial requirements for these elements and eliminating any additional projection thereof.

The supply element can be removably located on the holder for the thread supply drum, thus permitting replacement for repair or maintenance, or for substitution, or entire removal, so that the thread supply drum can be used universally and also with machines on which supply thread brakes are already located, for example away from the supply storage drum itself.

Thus, the thread supply device in accordance with this feature of the invention is so arranged that it can be universally used with various types of machines, thereby decreasing the requirement for stocking of replacement or repair parts in a knitting mill which has knitting machines of various manufacturers and of various types.

The thread supply portion can maintain its normal position either by its own weight, or by spring loading acting against the tension of thread or yarn supplied from the yarn package. The tension applied to the incoming thread thus can be held at any design value, resulting in excellent thread supply conditions. In some instances, particularly when handling delicate threads or yarns, in which the force occurring when compensating for yarn drag should be very small, it is possible to so arrange spring forces that they tend to oppose the force of gravity acting on the movable, typically pivotably arranged supply portion, by at least partially compensating for the weight of the supply portion.

The supply portion preferably additionally includes a yarn drag stop-motion sensor reacting, for example, if the movement of the supply portion, due to yarn drag, extends beyond a predetermined position.

The thread storage drums are usually driven by a drive belt, common to all the thread storage devices and, in turn, driven from a common drive pulley. The drive arrangement is particularly simple if the drive belt is looped about a portion of the thread supply drum above that region on which the storage supply windings are placed. In accordance with a feature of the invention, the supply portion carries a belt guide element which guides the belt in proper position around the thread supply drum. If the main drive pulley for the belt should be changed, or its position altered, the thread on the storage winding is thus not affected by a possible shift of the belt, since the belt is held in its predetermined position on the drum by the guide element. This guide element is preferably so formed that it has a guide surface which is slightly spaced from the belt when the belt is in its proper operating position. Upon tipping the supply portion, for example during maintenance or repair, the guide element is swung away from the belt, thus providing access thereto.

Drawings, illustrating preferred examples, wherein.

Figure 1:
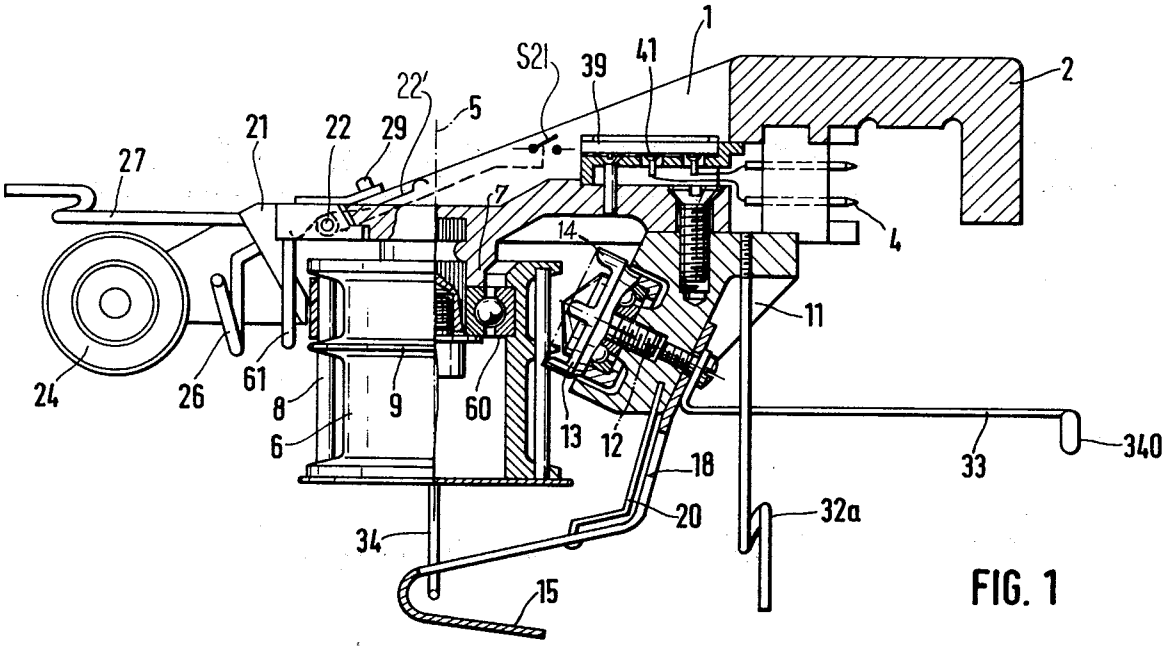
FIG. 1 is a highly schematic side view of a thread supply device, partly in section, and omitting elements not necessary for an understanding of the invention.

The thread supply device is attached to the support frame or ring of a knitting machine (not shown) by means of a holder 1 (FIG. 1) which has a U-shaped end portion, forming a hook 2 which can be hooked over the support ring of the knitting machine. The hook portion 2 has a threaded hole therethrough; a clamping bolt 3 (FIG. 2) is passed through the hook-shaped end 2 to clamp the holder 1 on the support ring. Two electric contact prongs 4 project from the holder 1 opposite the bolt 3; when the holder 1 is associated with a knitting machine, the contact prongs 4 engage suitable sockets formed on the knitting machine to connect with the stop-motion circuit of the knitting machine. Knitting machines, as is customary, have an electrical cable with suitable connecting plugs on the support ring which, in turn is connected with the machine control system to effect stop-motion if a thread should break.

A thread storage drum 6 is rotatably journalled by bearing 60 in holder 1, and seated on a hub 7 of the drum. Drum 6 rotates about axis 5. Drum 6 is formed like a squirrel cage, that is, has a plurality of rods 8 circumferentially arranged. The drum 8 is subdivided into two drum portions, an upper portion and a lower portion, by a separating bead 9. A toothed or ribbed belt 10 (FIG. 3) engages the rods 8 in the region of the upper portion of the drum 6. Belt 10 is driven from a suitable drive source on the knitting machine, thereby rotating drum 6 about its axis 5.

Figure 4:
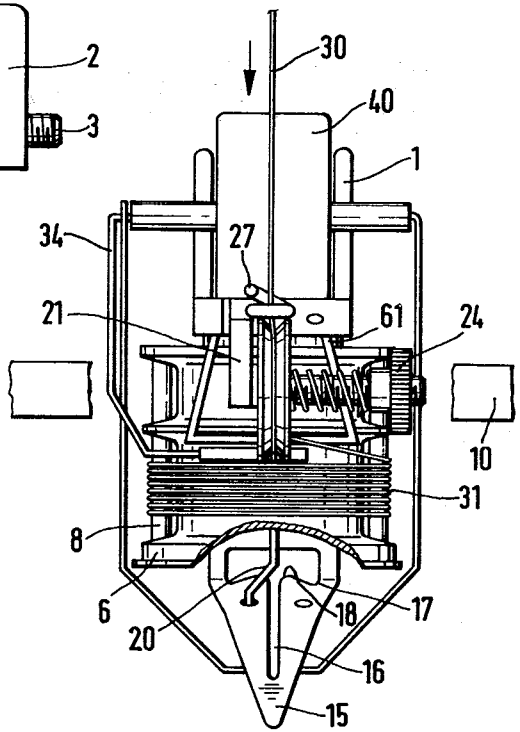
FIG. 4 is a front view of the supply device, partially cut away.

A projecting arm 11 is secured to the lower portion of holder 1. Arm 11 carries a gear wheel 13 which engages in the gaps between the rods 8 of the lower portion of the drum 6. Gear wheel 13 is rotatable about an axis 12 which is inclined with respect to the axis 5 about which drum 6 can rotate. U.S. Pat. No. 4,028,911, Fecker et al, illustrates such an arrangement in greater detail. The depending arm 11 additionally carries a thread guide element 15 which, as best seen in FIG. 4, is formed with a thread guide slit 16 directed towards the axis 5 of the drum 6, and communicating with an opening 17 although separated therefrom by a pair of shoulders 18, one on each side of the slit. The arrangement is symmetrical with respect to the slit 16. One side, respectively, of the opening can be blocked by bail 20. Reference is made to U.S. application Ser. No. 827,966, filed Aug. 26, 1977, Fecker et al, now U.S. Pat. No. 4,114,823, for details relating to the thread guide 15.

Figure 3:
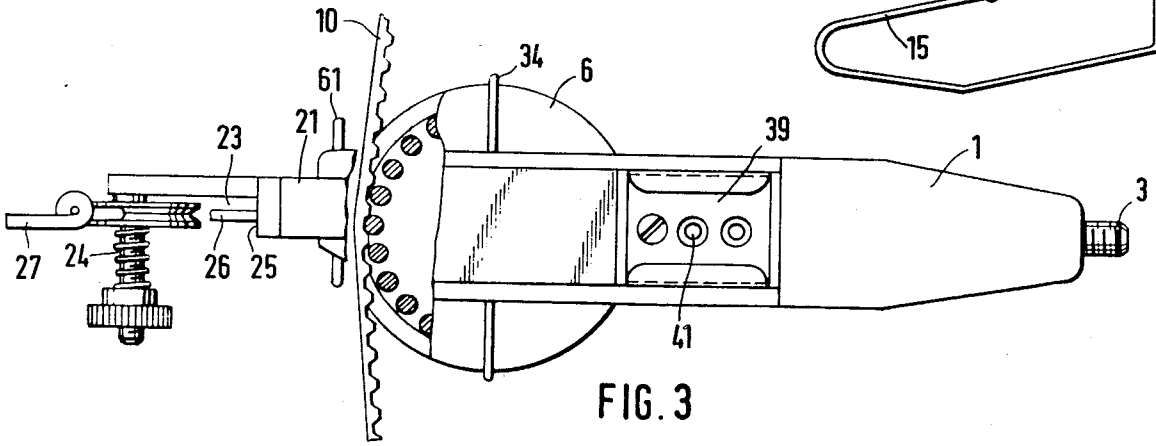
FIG. 3 is a top view of the device of FIG. 1, partially cut away to show the construction of the drum.

In accordance with the present invention, the thread brake 24 and a thread guide element 26 are movably secured to the holder 1 by means of a supply or front portion in form of a rail 21 secured to the forward portion of the holder 1 by a pin 22, so that the rail 21 and with it brake 24 and guide element 26, as well as a further supply guide eye 27 can be pivoted out of the path of the drum 6, either manually, or upon occurrence of thread drag. As clearly seen in FIG. 3, holder 1, in accordance with a feature of the invention, is narrower than the diameter of the drum 6. The front portion 21, likewise, is no wider than the holder 1 and, as shown in FIG. 3 and preferred, is a still narrower rail. The portion 21 is formed with a lateral notch or relief 23 (FIG. 3) in which the supply thread brake 24 is secured. The notch or relief 23 is limited by a shoulder 25 on which the supply thread guide element 26 is secured. The supply guide element 26 is in the form of a hook which is open at one side. The supply yarn guide 27 is formed as an open "pigtail" eye.

The rail forming the supply portion 21 can be locked in the position shown in FIG. 1 by a slidable strap 29 secured to the holder 1.

Figure 2:
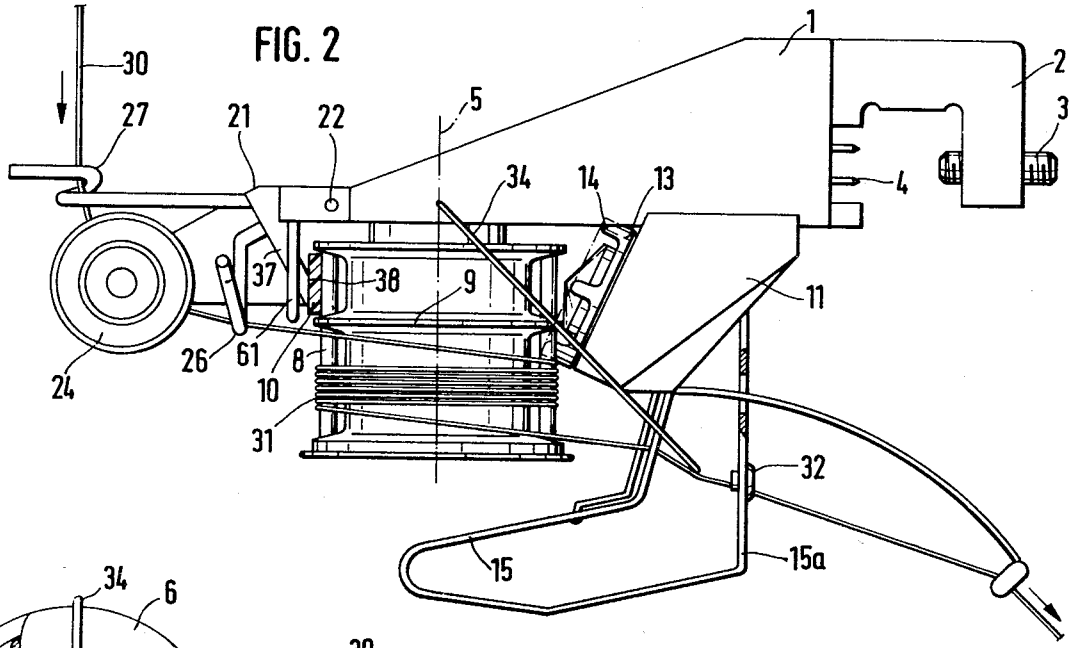
FIG. 2 is a schematic side view of the thread supply device of FIG. 1, in normal operating condition.

Yarn 30 (FIG. 2) supplied from a yarn package (not shown) is threaded through the inlet supply eye 27, then passed through the supply thread brake, then through the thread guide element 26 and directed, tangentially, unto the supply drum 6, where it is wrapped several times about the drum to form a storage winding 31. The thread is then taken off the storage winding, approximately tangentially, guided over the shoulder 18 (FIGS. 1,4) of the thread guide element 15 and then through a take-off eye 32 (FIG. 2). The take-off eye may be part of the thread guide element 15 (FIG. 2) or may be separately located on a separate support as shown at 32*a*, FIG. 1. The take-off speed of the thread or yarn from storage drum 6 is equal to the supply speed with which the thread 30 is wound on drum 6.

The take-off eye 32*a*, in accordance with FIG. 1, is an open eye, that is, in the form of a pigtail, to facilitate threading. In FIG. 2, the eye 32 is closed and secured to an arm 15*a* integral with, or attached to the guide element 15. An arm 33 of springy, resilient material is attached to the bracket or arm 11, carrying a further thread guide eye 340. The arm as shown in FIG. 1 is unloaded; as shown in FIG. 2, it is resilient deflected by thread tension due to the pull applied on the thread by the utilization apparatus, for example a knitting feed of a circular knitting machine. The resilient arm 33 provides some additional thread reserve for the yarn being pulled off so that short-time variations in thread demand which, for example, occur when making plush fabric, or upon feed pull of the needles, can be compensated.

Presence of the thread being pulled off is monitored by a pull-off sensing arm 34 which is located on holder 1, pivotable about a horizontal axis. The arm 34 bears on the pulled-off thread by its own weight, or can be spring-loaded. If the thread pull-off tension decreases, arm 34 will pivot in clockwise direction, with respect to FIG. 2. The yarn sensing arm 34 can be locked in the position shown in FIG. 1 so that it can control thread pull-off over the end of drum 6, that is, for demand feed, in which case the stop-motion switching mechanism attached to the arm 34 is disabled or disconnected.

Operation: Under normal operating conditions, yarn 30 supplied from a package is threaded about the drum 6, and will have the path shown in FIG. 2. The supply portion 21 will be horizontal, that is, it will have the position shown in FIG. 2. If, due to yarn drag, the tension on the supply side of the yarn to the drum should increase, the additional tension will lift the entire front portion, that is, thread brake 24, arm 21, and all elements secured thereto, from the position shown in FIG. 2 to a raised position, as shown, for example, in FIG. 6, or in FIG. 5 in chain-dotted lines. Since the part 21 is pivotable about pin 22, forming a pivot axis, the weight of the entire supply portion 21 will result in a counteracting force which, with reference to FIG. 6, for example, tends to hold the entire part 21 and all elements secured thereto in the position shown in FIG. 2, that is, in its normal or oriented position. This force, determined by the weight of the arm 21 and all attachments thereon, can be overcome by increased thread tension at the supply side arising, for example, due to thread drag. It limits the thread tension which can arise, as a maximum, at the supply side.

It is frequently not necessary to stop the machine even if the tension of the thread being supplied to drum 6 increases. Such tension increases may last only for short periods of time. Lifting of the inlet portion 21 permits compensation for such instantaneous or short-time tension peaks, automatically, and without interruption of production. If supply from the yarn package is truly interrupted, however, that is, if the yarn is not only dragging but jammed, then it is necessary to stop the machine to prevent breakage of the yarn. The arm 21, therefore, cooperates with an electrical switch located within the structure of holder 1, and shown only symbolically at S21 in FIG. 1. Switch S21 can be operated, for example, by a small cam-like extension formed on the arm 21 beyond pin 22 and pressing down on a spring contact arm to establish or break a normally closed contact if the arm 21 deflects beyond a certain limiting position. The electrical contacts of switch S21 are connected to the prongs 4, for example, for additional connection to the stop-motion system of the machine, to control the stop-motion system thereof.

The supply portion 21 can be arranged in various ways with respect to switch S21. For example, the supply portion 21 can be so arranged that its normal position is slightly raised as seen, for example, in the solid-line position of FIG. 6. If the portion 21 drops down to the horizontal—FIG. 2—then this is an indication that no tension is applied at all and the stop-motion can be operated; if the portion 21 is lifted beyond a certain limiting position, for example close to the vertical (FIG. 5), this is an indication that the tension at the supply side is excessive and, likewise, causes operation of the stop-motion system of the machine. Such switching action can readily be obtained by forming a controlled cam for a switching spring of switch S21 with two projecting lands, one each controlling the switch depending on the position of the portion 21—completely down or strongly raised.

Figure 6:
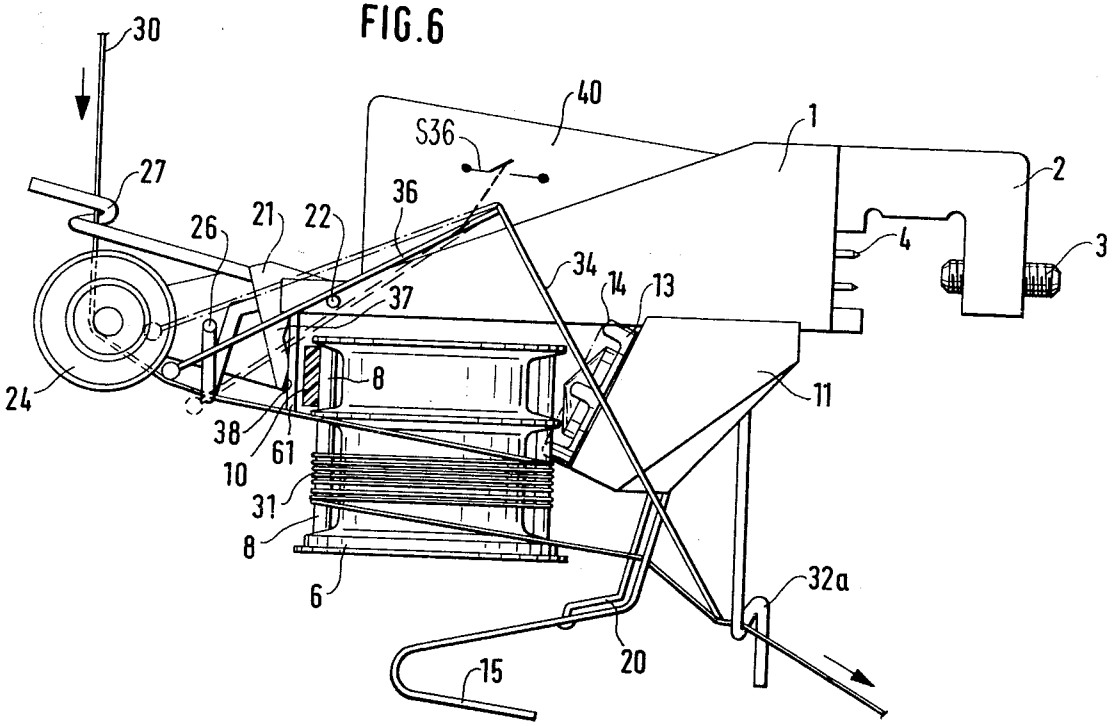
FIG. 6 is a side view of yet another embodiment in which the supply portion is partially tipped upwardly in response to yarn drag.

FIG. 6 illustrates an embodiment in which a supply thread sensing element is additionally provided which senses presence of the thread 30 between the thread brake 24 and the thread guide hook 26. The supply thread sensor 36 is engaged by the thread 30, bearing thereon by its own weight. Upon thread breakage, the sensor 36 changes from its normal or ordinary operating position shown in solid lines in FIG. 6 to the position shown in broken lines, thus causing operation of a switch S36, shown schematically in FIG. 6. If excessive yarn drag is sensed, the supply portion 21 is tipped upwardly beyond a limiting angle. This carries along the thread sensing arm 36 and brings it into the chain-dotted position in which, again, a stop-motion signal is supplied. The electrical switches, as symbolically shown, are drawn in their open position, for convenience of illustration.

The tension supplied by the supply portion 21 can be adjusted by adjusting the braking action of thread brake 24 and, further, by the weight of the element 21. It is also possible to additionally control operation based on tension of the supply thread 30 by spring-loading the element 21. Depending on the type of yarn being handled, and the type of textile machine with which the thread supply device is to be associated, the resulting force applied to the supply yarn 30 can be so modified by an additional spring that it either supports the force of gravity, due to weight of the portion 21, or counteracts the force of gravity, depending upon whether the spring tends to depress the element 21 into the position shown in FIG. 1, or tends to raise it into the position shown in FIG. 6, for example. Such spring force can be applied, for example, by a small spiral spring 22' wrapped around pin 22 and acting on the elements 21. The spring can also be so arranged that it completely balances the weight of the element 21 so that there will be no resulting force due to gravity; any thread tension which arises due to the friction action of thread brake 24 on the supply yarn 30 will then be balanced entirely by the spring.

The drum 6 is rotated by the belt 10. Belt 10, under normal operating conditions, is snugly looped about a fraction of the circumference of the upper portion of drum 6. If the tension of the belt 10 should fail, for example upon maintenance or replacement of another yarn supply device, adjustment of the belt drive or the like, loss of the contact between the drum 6 and the belt may result, and the belt might then slip and interfere with an already threaded thread or yarn and wound on the drum 6. To hold the belt 10 in position, a belt shoe 37 is located on the bottom of the supply portion 21 which has a holding surface 38 facing the belt 10—see specifically FIG. 6. The holding surface 38, in the normal operating position of the supply part 21, is slightly spaced from the belt 10. The spacing is such that belt 10, even if slack, cannot slip over the bead 9 which separates the upper and lower portion of the drum 6.

Figure 5:
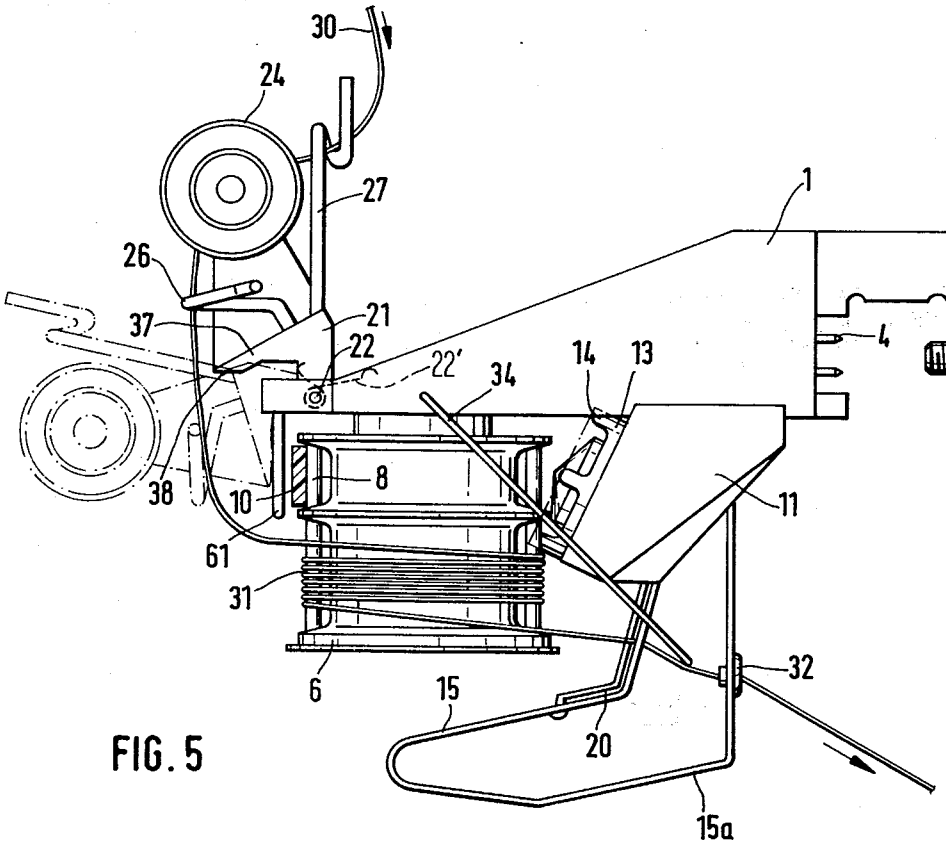
FIG. 5 is a schematic side view of another embodiment of the invention, showing the supply portion tipped upwardly in solid lines, and in normal position—in chain-dotted lines.

Access to the drum and to the belt is easy if, in accordance with the present invention, the supply part 21 is tipped into a vertical position as shown in solid lines in FIG. 5. This permits ready placement of the belt 8; the holding surface 38 on the belt shoe 37 is now clear of the belt 10. In a preferred form, a spring catch is associated with the holder 21 to lock the holder 21 in position so it cannot, inadvertently, fall down.

To prevent possible interference between the thread 30 and the belt 10 if the supply portion 21 is pulled into the solid-line position shown in FIG. 5 due to an excessive jamming or drag on the drag on the thread, a further thread guide bail or guide element 61 which can be shaped as a U-element or an L-element is provided, the lower edge or bar of which is approximately at the level of the bead 9 of the drum 6. The separating element 61 separates the drum into a storage portion and a drive portion and provides for effective separation of the supplied yarn from the belt, thus preventing any possible tearing or accidental contact.

The electrical portion of the system, for example the switches associated with the yarn sensing bars 34, 36, can be located in a separate housing 40 (FIG. 6) which, preferably, is removable from the holder 1 and forms an intermediate holder element. Housing 40 is attached to the holder 1 which then forms a terminal holder element by a snap-in shoe-and-socket connection 39 (FIG. 1) which simultaneously provides for mechanical attachment of the housing 40 and electrical connection to contacts 41 which, in turn, are connected to the contact prongs 4. The housing 40 preferably includes the electrical contact elements for the thread sensing bails. In a accordance with a feature of the invention, the supply portion 21 is also secured to the housing 40 by passing pin 22 through a projection of the housing 40; in accordance with another embodiment, the pin 22 which connects portion 21 is connected to a separable element which is plug-connected to the holder 1, and likewise attached thereto with a plug-socket connection, or projection-recess interconnection, for example in the form of a dovetail joint, or the like, so that the entire portion 21, together with the thread brake 24 and the various thread guide elements 26, 27, 61 and the belt shoe 37 can be removed from the holder 1 as a unit. The socket 39 (FIG. 3) is preferably formed with projections, for example in the form of in-turned edge flaps (FIG. 3) fitting around grooved dovetail projections formed on either the housing 40 or an additional separable extension from the supply element 21. The connection, in its simplest form, can be similar to the well-known connection of flash equipment to cameras.

The supply part 21, in its preferred form, is so attached that it can pivot with respect to the holder 1. Movement of the supply part 21, essentially in a vertical direction, which may include the arc about pin 22, is not necessarily a rotary one, however; the supply element 21 can also be secured to the holder 1 to be vertically movable in a sliding path about a vertical bracket or guide rail located at the forward end—with respect to the drum 6—of the holder 1. The pivotal connection using a pin 22 as described in detail is preferred because of the simplicity of attachment. Any other movable attachment of the supply portion 21, including at least a thread brake or a supply guide element may, however, be used.

Forming the drum as an open cage has the advantage that it lends itself readily to engagement with a ribbed or toothed belt, the ribs or teeth engaging in the gaps between the rods 8. Positive drive, therefore, is effected between the belt and the drum 6 due to the interengagement of the ribs and bars. The open construction of the storage drum also prevents accumulation of fluff and lint in the region of interengagement between the belt and the drum which, otherwise, might arise if the drum in the region of the engagement with the belt were solid. The speed of rotation of the drum causes centrifugal force to act on lint which has the tendency to throw off any lint which might form on or attach itself to the bars 8. Practical experience has shown that an open drum, subdivided merely by a bead to separate the region of engagement of the belt 10 and the thread storage windings 31 contributes not only to positive drive and engagement, but to cleanliness of the entire device.

Various changes and modifications may be made, and features described in connection with any one of the embodiments may be used with any of the others, within the scope of the inventive concept.

We claim:

1. Drag compensated thread or yarn supply apparatus, particularly for a circular knitting machine in which thread (30) is supplied to the apparatus in a supply path, having a holder (1) for assembly to the machine;

a thread supply drum (6) rotatably journalled on the holder;

a thread supply guide element (26, 27) guiding the thread (30) to the drum to wind a storage winding (31) thereon;

thread take-off guide means (15, 32) guiding thread being taken off the drum;

a thread brake element (24) located in the supply path of the thread (30) to the drum (6), a support member (21) positioned adjacent the drum (6) in the supply path of the thread the thread brake element (24) being secured to and supported on said support member, and comprising, in accordance with the invention, means (22) for movably securing said support member (21) to the holder for limited deflecting movement backwardly—with respect to feed of the thread—in the supply path of the thread, to permit limited deflection of said thread brake element (24) in the supply path and accomodate changes in tension of the thread in the supply path.

2. Apparatus according to claim 1, further including a thread directing element (26) located on the support member (21) and directing the thread for winding on the drum to form said storage winding (31).

3. Apparatus according to claim 2, wherein said thread directing element (26) is hook-shaped.

4. Apparatus according to claim 1, wherein;

the support member (21) is pivotably secured to the holder (1) to pivot about a pivot axis (22) which is transverse to the axis of rotation (5) of the drum (6).

5. Apparatus according to claim 1, further comprising means (29) locking the support member (21) in a predetermined position with respect to the holder.

6. Apparatus according to claim 1, wherein the width of the holder (1) is less than or at most equal to the diameter of the supply drum (6).

7. Apparatus according to claim 1, wherein the support member comprises a flat rail-like element (22), pivotably secured to the holder (1) to pivot about a pivot pin or axis (22) transverse to the axis of rotation (5) of the drum (6);

and the thread brake (24) is located at a side of said flat rail-like element (22).

8. Apparatus according to claim 7, wherein said flat rail-like element is formed with a shoulder and lateral recess or notch (23) adjacent the shoulder, in which the thread brake (24) is received;

and wherein the thread supply guide element (26, 27) is secured to the shoulder adjacent the recess or notch on the rail-like element.

9. Apparatus according to claim 1, wherein the support member (21) is removably secured to the holder (1).

10. Apparatus according to claim 1, wherein the thread brake (24) is positioned with respect to the drum (6) to provide a bias drag force loading on the thread (30) being supplied to the drum.

11. Apparatus according to claim 10, wherein the thread brake element applies tension to the thread (30) supplied to the drum, and further comprising spring means (22') connecting said holder (1) and said support member (21) and modifying the effect of the weight of the holder, and the at least one element secured thereto, on the tension exerted on the thread (30) being supplied to the drum.

12. Apparatus according to claim 1, further including switch means (S21) coupled to the support member (21) and operating upon movement thereof to operate a stop-motion device of the machine upon sensing of excessive yarn drag.

13. Apparatus according to claim 1, wherein the machine has a drive belt (10) arranged for rotary drive of the drum (6);

wherein said drum (6) is formed with a storage portion receiving the storage winding (31) and with a drive portion for engagement with the belt (10) separate from the storage portion;

and a belt guide element (37) is secured to the movable support member (21), and movable therewith, the belt guide element ensuring positioning of the belt (10) with respect to the drum (6) when the support member is in its normal operating position, but permitting access to the belt when the support member is moved out of a normal operating position.

14. Apparatus according to claim 13, wherein the belt guide element (37) is formed with a belt support surface (38) which is normally slightly spaced from the belt, when the belt is engaged with the drum (6) for operation thereof, but removable from said close spacing with respect to the belt upon movement of the support member (21).

15. Apparatus according to claim 13, wherein the drum, at least in the region of engagement with the belt (10) is an open, or squirrel cage drum;

the belt is ribbed or toothed, the spaces between the ribs or teeth being engaged by rod elements forming the squirrel cage drum for positive drive thereof.

16. Apparatus according to claim 1, further including a supply thread presence sensing means (36) engaging the thread (30) being supplied to the drum in the thread path between the thread brake (24) and the thread supply guide element (26).

17. Apparatus according to claim 16, further comprising switch means (S36) in operative connection with the thread presence sensing means (36) and connected to a stop-motion system of the machine.

18. Apparatus according to claim 1, for use with a textile machine, wherein the holder includes an intermediate holder element (40) to which the support member (21) is deflectably secured, and a terminal holder element adapted to be attached to the textile machine;

and further including shoe-and-socket connection means (39) attached to the intermediate holder element (40) and the terminal holder element, respectively, to provide for selective movable attachment of the support member (21) from the machine (1).

19. Apparatus according to claim 1, wherein the support member (21) is pivotably connected to the holder (1) to pivot about an axis (22) transverse to the axis of rotation (5) of the drum (6);

and switch means (S21) are associated with and operatively connected to the support member (21), operative upon deflection of the support member from a normal or operating position to either a fully raised position upon sensing of excessive yarn drag on the thread brake (24) or to a dropped position upon breakage of thread (30) being supplied to the drum, to operate a stop-motion system of the machine.

20. Apparatus according to claim 13, further including a thread hold-down bail (61) secured to the holder (1) and located behind and adjacent to the belt (10) to separate the belt from thread being supplied to the drum upon movement of the support member and hence of the thread brake from a normal position and to prevent entanglement of thread with the belt and maintain the path of delivery of the thread to the drum to form said storage winding (31) thereon substantially constant immediately in the vicinity of the circumference of the drum.

21. Apparatus according to claim 1, wherein the movable support member carries the lead-in thread guide eye element (27), the thread brake (24), and a thread-directing element (26), in that order, in the path of thread (30) being supplied to the drum (6) and forming, respectively, said elements.

22. Apparatus according to claim 21, wherein the machine has a drive belt (10) arranged for rotary drive of the drum (6);

wherein said drum (6) is formed with a storage portion receiving the storage winding (31) and with a drive portion for engagement with the belt (10) separate from the storage portion;

and a belt guide element (37) is secured to the movable support member (21), and movable therewith, the belt guide element ensuring positioning of the belt (10) with respect to the drum (6) when the support member is in its normal operating position, but permitting access to the belt when the support member is moved out of a normal operating position.

23. Apparatus according to claim 22, further including a thread hold-down bail (61) secured to the holder (1) and located behind and adjacent to the belt (10) to separate the belt from thread being supplied to the drum upon movement of the support member and hence of the thread brake from a normal position and to prevent entanglement of thread with the belt and maintain the path of delivery of the thread to the drum to form said storage winding (31) thereon substantially constant immediately in the vicinity of the circumference of the drum.

24. Apparatus according to claim 22, wherein the support member comprises a flat rail-like element (22), pivotably secured to the holder (1) to pivot about a pivot pin or axis (22) transverse to the axis of rotation (5) of the drum (6);

and the thread brake (24) is located at a side of said flat rail-like element (22).

25. Apparatus according to claim 22, further including switch means (S21) coupled to the support member (21) and operating upon movement thereof to operate a stop-motion device of the machine upon sensing of excessive yarn drag.

* * * * *